US005084710A

United States Patent [19]

Whittington

[11] Patent Number: 5,084,710

[45] Date of Patent: Jan. 28, 1992

[54] ELECTRONIC MEANS FOR SWITCHING ANTENNAS TO A COMMON BUS

[75] Inventor: Mark Whittington, Austin, Tex.

[73] Assignee: Minnesota Mining and Manufacturing Company, St. Paul, Minn.

[21] Appl. No.: 616,641

[22] Filed: Nov. 21, 1990

Related U.S. Application Data

[63] Continuation of Ser. No. 386,509, Jul. 28, 1989, abandoned.

[51] Int. Cl.[5] ..... H01Q 3/240; H01Q 7/00

[52] U.S. Cl. ..... 343/876; 333/103; 343/742; 343/867

[58] Field of Search ..... 324/326; 333/101, 103; 343/742, 855, 867, 876, 853, 741, 866; 455/273, 274, 277

[56] References Cited

U.S. PATENT DOCUMENTS

| | | | |
|---|---|---|---|
| 3,840,875 | 10/1974 | Neal | 343/876 |
| 3,893,025 | 7/1975 | Humphreys, Jr. | 324/326 |
| 4,220,913 | 9/1980 | Howell et al. | 324/326 |
| 4,295,095 | 10/1981 | Thomas et al. | 324/326 |
| 4,343,001 | 8/1982 | Anderson et al. | 343/745 |
| 4,387,340 | 6/1983 | Peterman | 324/326 |
| 4,438,389 | 3/1984 | De Sa | 324/326 |
| 4,499,606 | 9/1985 | Rambo | 455/277 |
| 4,520,317 | 5/1985 | Peterman | 324/326 |
| 4,542,344 | 9/1985 | Darilek et al. | 324/326 |
| 4,656,364 | 4/1987 | Yokogawa et al. | 307/112 |
| 4,843,401 | 6/1989 | Bass | 343/701 |

FOREIGN PATENT DOCUMENTS

| | | | |
|---|---|---|---|
| 1222131 | 8/1966 | Fed. Rep. of Germany | 343/876 |
| 0165879 | 8/1985 | Japan | 455/277 |

*Primary Examiner*—Michael C. Wimer
*Assistant Examiner*—Peter Toby Brown
*Attorney, Agent, or Firm*—Gary L. Griswold; Walter N. Kirn; Jack V. Musgrove

[57] ABSTRACT

A circuit for selecting an input to a signal processing network from among several switchable antenna units. Each antenna unit includes a winding which is connected to a common signal bus. The switchable antenna units may be placed in "on" or "off" states in response to a controller, such as a microprocessor. One terminal of each winding is connected to a transistor which causes the terminal to be in an open condition when the unit is unselected, attenuating any signal which might otherwise be transmitted to the signal bus. A second winding is inductively coupled to the first winding and is used to improve attenuation of unselected signals.

17 Claims, 2 Drawing Sheets

ELECTRONIC MEANS FOR SWITCHING ANTENNAS TO A COMMON BUS

CROSS-REFERENCE TO RELATED APPLICATION

This application is a continuation of U.S. Pat. application Ser. No. 07/386,509 filed July 28, 1989 and now abandoned.

BACKGROUND OF THE INVENTION

1. Field of the Invention

The present invention generally relates to electronic switches, and more particularly to electronic control of switchable antenna units utilizing a common signal bus.

2. Description of the Prior Art

Antenna arrays are used in a variety of applications, such as underground cable location, radio navigation, and electromagnetic field detection. It is often necessary to route the signals from multiple antennas to a signal processing network in order to prepare the signals for data analysis. Where the application permits, it is desirable to utilize a single signal processing network for the entire antenna array rather than using multiple networks, i.e., one for each antenna. Because of this, systems have been devised which sequentially switch the network input from one antenna to another.

The simplest mechanism for achieving sequential inputs is a manual switch, such as a single pole-single throw contact. A plurality of such devices may be used in an antenna array (one for each antenna), or a multi-contact switch may be used. A more convenient alternative is a conventional relay, such as a solenoid coil utilizing an armature contact. An example of a relay used in conjunction with two antennas is disclosed in U.S. Pat. No. 4,387,340 issued to E. Peterman (and in the divisional case, U.S. Pat. No. 4,520,317).

For most applications, however, the switching time of such relays is highly unsatisfactory. An improved, quicker design is illustrated in U.S. Pat. No. 4,542,344 issued to Darilek et al. A simplified version of the electrical configuration of that device is shown in FIG. 1. The prior art structure includes a plurality of loop antennas 1, each connected to one of a plurality of preamplifiers 2. The outputs of preamps 2 are connected to a multiplexer 3 which is regulated by a controller 4. Controller 4 selects the antenna or channel to be analyzed at any given time. The selected signal is then directed from multiplexer 3 to the signal processor circuit 5, which conveys data in a comprehensible form to an output device (display) 6 via controller 4.

The foregoing devices still possess a significant disadvantage, to wit, the necessity of providing a preamplifier for each antenna. This drawback, which is uneconomical and redundant, is accentuated by the fact that other electrical components may have to be provided for each antenna. For example, FIG. 3 of U.S. Pat. No. 4,295,095 issued to Thomas et al. shows use of a plurality of filters, one for each channel, in addition to the preamplifiers. It would, therefore, be desirable and advantageous to devise means for selectively switching the input of a signal processor from among a plurality of antennas without requiring the redundant use of electrical components for each antenna channel.

Accordingly, the primary object of the present invention is to provide means for selecting a signal from one of a plurality of antennas.

Another object of the invention is to provide such means having a rapid switching time.

Still another object of the invention is to provide switchable antenna units whose output may be directed to a common signal bus.

Yet another object of the invention is to provide a switchable antenna unit that does not require preamplifiers or other signal conditioning components.

A further object of the invention is to provide such a switchable antenna unit having sufficient attenuation of the signal when the unit is not selected.

SUMMARY OF THE INVENTION

The foregoing objects are achieved in a switchable antenna unit having a loop antenna and switching means for selectively enabling and disabling the antenna. The antenna includes a first winding, one end of which is connected to a common signal bus. The second end of the first winding is effectively open in the disabled or unselected state, resulting in signal attenuation. The switching means is responsive to a controller and, when enabled, causes the second end of the first winding to become connected to ground, thereby allowing signal transmission to the common bus.

A second winding is provided as part of the switching means, the second winding being inductively coupled to the first winding. When the switching means is disabled, the second winding is effectively shorted and provides improved attenuation of the signal from the first winding. In the preferred embodiment, the switching means comprises a NPN transistor connected to the first winding, and a PNP transistor connected to the second winding, the base of each transistor being connected to the controller.

BRIEF DESCRIPTION OF THE DRAWINGS

The novel features of the invention are set forth in the appended claims. The invention itself, however, will best be understood by reference to the accompanying drawings, wherein:

DESCRIPTION OF THE PREFERRED EMBODIMENT

Figure 1:
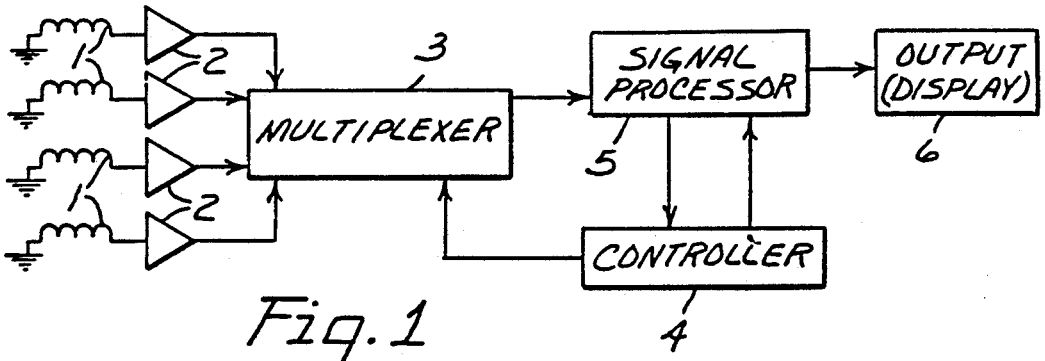
Fig. 1 (PRIOR ART)
FIG. 1 is a block electrical diagram of a typical prior art antenna array utilizing a plurality of pre-amplifiers.
Figure 2:
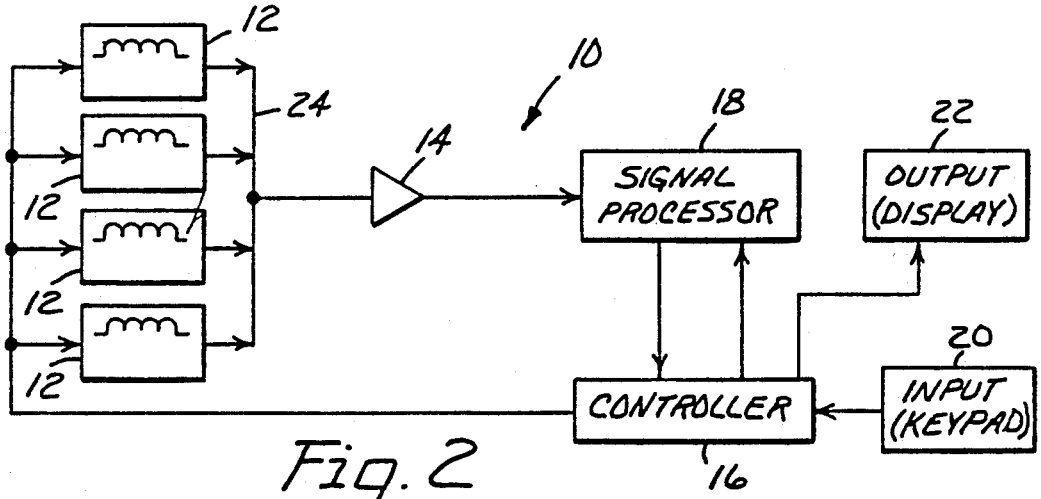
FIG. 2 is a block electrical diagram of the present invention showing the switchable antenna units connected to a common signal bus.

With reference now to the figures, and in particular with reference to FIG. 2, there is depicted a network 10 for processing signals obtained from multiple antennas. Network 10 includes a plurality of switchable antenna units 12, a preamplifier 14, a controller 16, a signal processor 18, an input device 20, and an output device 22. Details of switchable antenna units 12 are discussed later in conjunction with FIGS. 3-6. The remaining components of network 10 are generally described below but, inasmuch as network 10 has several different applications, it will be appreciated that the exact configuration of these components greatly depends on the particular purpose for which network 10 is being used. Various configurations will readily become apparent to those skilled in the art.

Controller 16 may be a microprocessor (including RAM, ROM, etc.), or simply a clock pulse generator, as shown in U.S. Pat. No. 4,295,095 issued to Thomas et al. If controller 16 is a clock pulse generator or other non-programmable component, then input device 20 is unnecessary. Therefore, its inclusion in network 10 is optional. Even if controller 16 is a microprocessor, input device 20 may still be unnecessary, e.g., where the microprocessor is pre-programmed and no user inputs are required. An example of such an application is shown in U.S. Pat. No. 4,542,344 issued to Darilek et al. If, however, network 10 is designed to require or allow user inputs (for either initial setup parameters or interactive participation) then input device 20 may conveniently take the form of a keypad. Controller 16 provides control signals for switching antenna units 12 between "on" and "off" states.

Switchable antenna units 12 are each connected to preamp 14 by a common signal bus 24. Preamp 14 is any conventional amplifier, and serves to boost the signal to an intermediate level for further processing. The signals from antenna units 12 are conveyed directly from preamp 14 to signal processor 18. Signal processor 18 may be as simple as an amplitude detector (see U.S. Pat. No. 4,438,389 issued to A. DeSa), or may include other signal conditioning devices, such as an automatic gain control, a bandpass filter, a variable gain amplifier (see the Thomas et al. patent), an analog-to-digital converter (see the Darilek patent), etc., or any combination thereof. The processed signals are generally conveyed to controller 16 which performs data analysis (e.g., amplitude ratios, phase comparisons, etc.), and outputs appropriate information to output device 22, typically an alphanumeric display.

Figure 3:
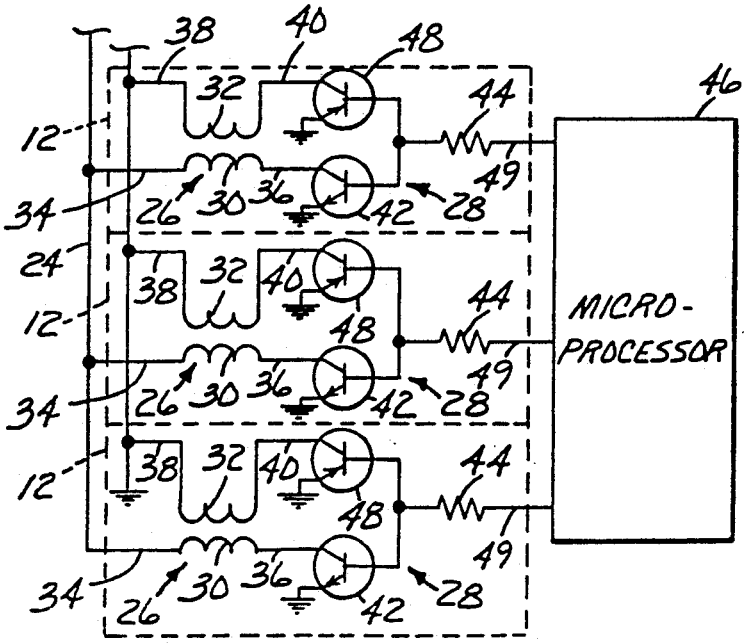
FIG. 3 is a detailed electrical schematic of the preferred embodiment of the switchable antenna units of the present invention.

Referring now to FIG. 3, the detailed construction of the switchable antenna units 12 is shown. Each switchable antenna unit 12 includes antenna means 26 and switching means 28. In the preferred embodiment, antenna means 26 is a loop-type antenna or induction coil, comprising a first winding 30, which receives ambient electromagnetic signals. In practice, first winding 30 is wrapped around a ferrite core, and a second winding 32 is physically wound over (and thus inductively coupled to) first winding 30. Therefore, the windings may conveniently be referred to as inner winding 30 and outer winding 32. Those skilled in the art will appreciate, however, that windings 30 and 32 could be placed side by side, both wrapped around the same core, or in any other manner which would inductively couple them together. Due to their physical proximity, inner and outer windings 32 might together be construed as antenna means 26 but, as noted below, outer winding 32 is actually part of switching means 28.

Each inner winding 30 has two terminals 34 and 36, terminal 34 (the output of antenna means 26) being connected to common signal bus 24, and terminal 36 being connected to switching means 28. Similarly, each outer. Winding 32 has two terminals 38 and 40, connected to ground and switching means 28, respectively. Winding 30 provides signal reception to bus 24, and winding 32 serves to attenuate the signal when that particular antenna unit 12 is unselected.

Switching means 28 is designed to switch antenna means 26 between "on" and "off" states, and could alternatively be described as enabling or disabling means. In the off state, terminal 36 of inner winding 30 is effectively open, which attenuates any signal that might otherwise be passed to bus 24. In the on state, terminal 36 is connected to ground, which allows the signal to flow to bus 24. In the preferred embodiment, switching means 28 includes an NPN transistor 42 whose collector is connected to terminal 36 of inner winding 30. The emitter of transistor 42 is connected to ground, and its base is connected, via a current limiting resistor 44, to the controller which, in the preferred embodiment, is a microprocessor 46.

Outer winding 32 is connected to switching means 28 in a manner similar to inner winding 30. One terminal 38 of outer winding 32 is connected to a common ground, and the other terminal 44 is connected to the collector of a PNP transistor 4s. The emitter of PNP transistor 48 is connected to ground. The base of transistor 48 is connected to resistor 44, which is in turn connected to microprocessor 46. It is anticipated that a microprocessor such as that sold under part number MC68HC11 by Motorola, of Austin, Texas, would be sufficient for the purposes contemplated herein.

Operation of switchable antenna units 12 is straightforward. A given switchable antenna unit is selected for signal reception when its control line 49 is biased positive with respect to ground. Conversely, a given unit is unselected when its control line 49 is biased negative with respect to ground.

For an unselected unit, transistor 42 is turned off, effectively leaving inner winding 30 in an open state which naturally attenuates signals that would otherwise be efficiently transmitted to bus 24. Transistor 48, on the other hand, is turned on, shorting outer winding 32. This also effectively shorts out inner winding 30, since the coefficient of coupling between the two windings is high, resulting in further attenuation of signals emanating from the unselected antenna unit. In this respect, outer winding 32 is properly considered part of switching means 28, rather than part of antenna means 26, since outer winding 32 does not present any signal to bus 24 and serves only to attenuate the signal in inner winding 30.

For the selected unit, transistor 42 receives a (positive) reference voltage from microprocessor 46, which turns transistor 42 on and allows the signal from inner winding 30 to pass to common bus 24. At the same time, transistor 48 is turned off, leaving outer winding 32 in an open state which has a negligible effect on signal reception. It should be noted that switchable antenna unit 12 might include only inner winding 30 without outer winding 32. In such a case, switching means 28 would include transistor 42 only, and not transistor 4s. For attenuation purposes, however, it is desirable to include an outer winding 32 which is also responsive to switching means 28.

In order to optimize the efficiency of switchable antenna units 32, it is advisable to provide transistors with a low dynamic saturation resistance and low collector to base capacitance. A low saturation resistance (from collector to emitter when the transistor is on) minimizes transistor noise in comparison to the desired antenna signal. A low collector to base capacitance is desirable for maximizing attenuation of the unwanted signal When switchable antenna unit 12 is in the off state. A transistor sold under part number NR041 by National Semiconductor of Santa Clara, California, has proven acceptable for the frequency range of 10 kilohertz to 1 megahertz.

It is also beneficial to keep the capacitance between inner and outer windings 30 and 32 as low as possible in order to improve attenuation of the signal when the antenna unit is unselected. This may be accomplished by increasing the separation between the windings which decreases the capacitance; however, this also decreases the mutual inductance between the windings, which is undesirable since attenuation improves with increased mutual inductance. Therefore, it is necessary to find an intermediate separation which optimizes both the capacitance between the windings and their mutual inductance. The inventor has found that a separation distance in the range of 0.7 to 1.5 millimeters is optimal for antenna windings approximately 5 centimeters long and about 1 centimeter in diameter.

Figure 4:
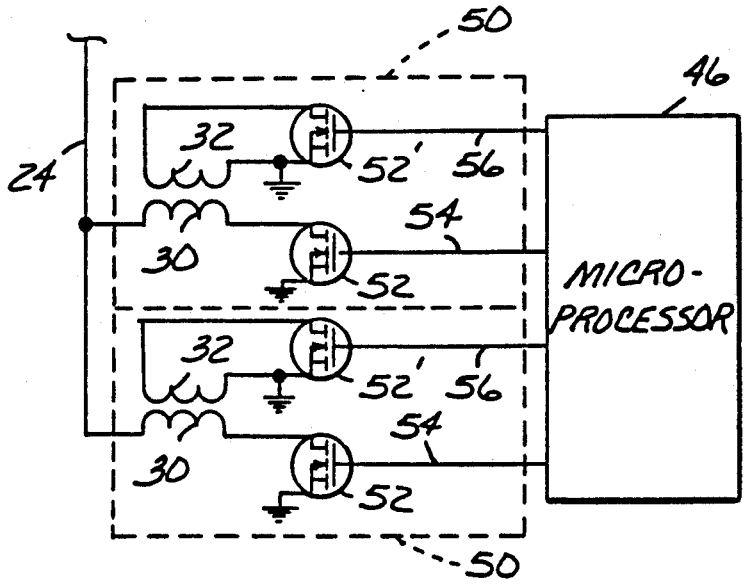
FIG. 4 is a detailed electrical schematic of an alternative embodiment utilizing MOSFET's.
Figure 5:
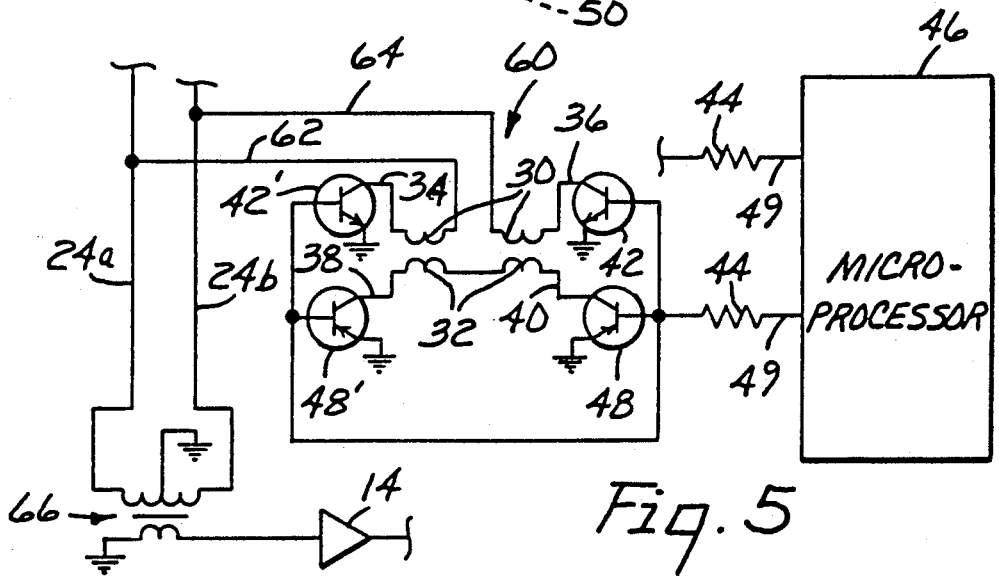
FIG. 5 is a detailed electrical schematic of an alternative embodiment providing a differential input to a paired signal bus.
Figure 6:
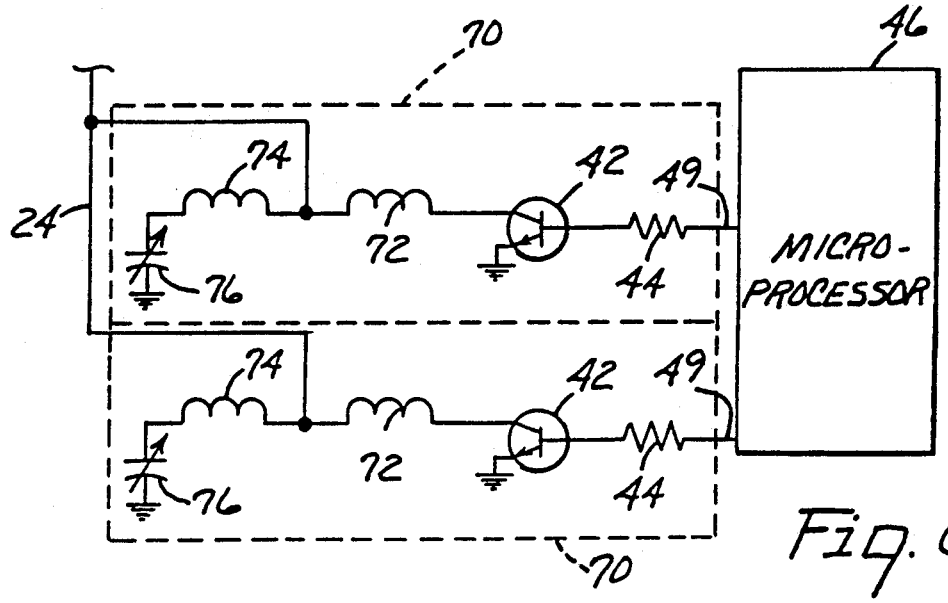
FIG. 6 is a detailed electrical schematic of an alternative embodiment in which the antenna and a capacitor form a bridge circuit.

Some alternative embodiments of the present invention are shown in FIGS. 4 through 6. With reference to FIG. 4, a switchable antenna unit 50 utilizing metal oxide semiconductor field-effect transistors (MOSFET's) is explained. In this embodiment, the transistors of FIG. 3 have been replaced with n-type MOSFET's 52. Each MOSFET 52 essentially functions in the same manner as transistor 42, but is less preferable since its resistance (in the on state) is generally higher than that of a bipolar transistor having approximately the same capacitance (in the off state). Additionally, switching transients are usually larger with MOSFET's than with bipolar transistors.

FIG. 4 illustrates another design alternative which may be used with either MOSFET's or bipolar transistors, namely, the use of two semiconductor devices of the same type as opposed to the use of complementary devices. This requires the provision of two control lines for each switchable antenna unit. In switchable antenna unit 50, one control line 54 is connected to MOSFET 52 which regulates inner winding 30, and the second line 56 is connected to MOSFET 52' which controls outer winding 32. In this configuration, it is presumed that the control signals emanating from microprocessor 46 are complementary, e.g., if line 54 is at zero volts, then line 56 is at the positive reference voltage. Those skilled in the art will appreciate that a single control line setup (such as that shown in FIG. 3) using MOSFET's may be afforded by making MOSFET 52' a p-type MOSFET. Alternatively, the two control line setup (with complementary control signals) may be used with bipolar transistors, in which case transistors 42 and 48 of FIG. 3 would both be NPN transistors.

Referring now to FIG. 5, a balanced antenna unit 60 is shown. Balanced antenna unit 6o still utilizes transistors 42 and 48, but additionally includes transistors 42' and 4s' in a symmetric configuration. The terminals 38 and 40 of outer winding 32 are connected to the collectors of PNP transistors 48' and 48, respectively. The terminals 34 and 36 of inner winding 30 are similarly connected to the collectors of NPN transistors 42' and 42, respectively. Now, however, inner winding 30 has been split, creating two intermediate output lines 62 and 64 which are connected to common signal **24*a* and 24*b*, respectively. Signal buses 24*a* and 24*b* are connected to a balanced transformer 66 whose output is directed to preamp 14. The emitters of all the transistors are connected to ground, and the bases of all the transistors are connected to microprocessor processor 46 via resistors 44. Balanced antenna unit 10 is useful in reducing noise from switching transients; the noise is attenuated since it occurs as a common mode input to balanced input transformer 66. The design shown in FIG. 5 is, however, more costly than the preferred embodiment of FIG. 3**.

Another alternative embodiment is shown in FIG. 6, to which attention is now directed. FIG. 6 illustrates the use of a bridged antenna unit 70 having two identical windings 72 and 74. One terminal of winding 72 is attached to the collector of NPN transistor 42, and one terminal of winding 74 is connected to a terminal of a variable capacitor 76. The other terminals of windings 72 and 74 are joined to provide a common output to signal bus 24. When variable capacitor 76 is properly adjusted (to the collector-base capacitance of transistor 42), antenna unit 70 forms a bridged circuit in the off state. In this state, the signals from windings 72 and 74 cancel each other out, resulting in a negligible output to common signal bus 24. The primary disadvantage of this structure is the great care which must be taken in adjusting variable capacitor 76 in order to achieve a balanced circuit.

Although the invention has been described with reference to specific embodiments, this description is not meant to be construed in a limiting sense. Various modifications of the disclosed embodiment, as well as alternative embodiments of the invention, will become apparent to persons skilled in the art upon reference to the description of the invention. For example, the antenna units may be tuned by the addition of a capacitor across the common signal bus if frequency selectivity were required (although this is deemed undesirable since it would affect the attenuation of unselected antenna signals). It is therefore contemplated that the appended claims will cover such modifications that fall within the true scope of the invention.

I claim:

1. A switchable antenna unit for receiving and conveying electromagnetic signals to a signal bus, comprising:

antenna means including a first winding having a first terminal for connection to the signal bus, and having a second terminal; and switching means connected to said second terminal of said antenna means for selectively attenuating signals received by said antenna means whereby, when said switching means is in an "on" state, said antenna means conveys said received signals to said first terminal and, when said switching means is in an "off" state, said received signals are attenuated by said switching means, said switching means including a second winding inductively coupled to said first winding.

2. The switchable antenna unit of claim 1 wherein said switching means has a control line for connection to an external controller.

3. The switchable antenna unit of claim 1 wherein said switching means causes said second terminal of said antenna means to be connected to ground when said switching means is in said "on" state, and said switching means causes said second terminal of said antenna means to be effectively open when said switching means is in said "off" state.

4. The switchable antenna unit of claim 3 wherein said switching means has a control line for connection to an external controller.

5. The switchable antenna unit of claim 4 wherein said switching means includes a transistor having a collector, a base, and an emitter, said collector being connected to said second terminal of said antenna means, said base being connected to said control line, and said emitter being connected to ground.

6. The switchable antenna unit of claim 4 wherein said switching means includes a metal oxide semiconductor field-effect transistor having a drain, a gate, and a source, said drain being connected to said second terminal of said antenna means, said gate being connected to said control line, and said source being connected to ground.

7. The swtichable antenna unit of claim 5 wherein said second winding has a first terminal connected to ground.

8. The switchable antenna unit of claim 7 wherein: said second winding further includes a second terminal;

said switching means further includes first and second transistors each having a collector, a base, and an emitter;

said collector of said first transistor being connected to said second terminal of said first winding;

said collector of said second transistor being connected to said second terminal of said second winding;

said bases of said first and second transistors being connected to said control line; and said emitters of said first and second transistors being connected to ground.

9. The switchable antenna unit of claim 8 wherein said first transistor is an NPN transistor and said second transistor is a PNP transistor.

10. An apparatus for selectively outputting signals received by an antenna array, comprising:

a common signal bus for carrying the received signals;

a plurality of switchable antenna units, each comprising:

antenna means including a first winding having a first terminal connected to said common signal bus, and having a second terminal, and switching means connected to said second terminal of said antenna means for selectively attenuating signals received by said antenna means whereby, when said switching means is in an "on" state, said antenna means outputs the received signals to said common signal bus and, when said switching means is in an "off" state, said received signals are attenuated by said switching means, said switching means further having a control line and including a second winding inductively coupled to said first winding; and control means connected to each said control line for selectively switching each said switching means between "on" and "off" states.

11. The apparatus of claim 10 wherein said switching means causes said second terminal of said antenna means to be connected to ground when said switching means is in said "on" state, and said switching means causes said second terminal of said antenna means to be effectively open when said switching means is in said "off" state.

12. The apparatus of claim 11 wherein each said switching means includes a transistor having a collector, a base, and an emitter, said collector being connected to said second terminal of said 13. The switchable antenna unit of claim 11 wherein each said switching means includes a metal oxide semiconductor field-effect transistor having a drain, a gate, and a source, said drain being connected to said second terminal of said antenna means, said gate being connected to said control line, and said source being connected to ground.

14. The apparatus of claim 11 wherein each said second winding has a first terminal connected to ground.

15. The switchable antenna unit of claim 14 wherein: each said second winding further includes a second terminal;

each said switching means further includes first and second transistors each having a collector, a base, and an emitter;

said collector of said first transistor being connected to said second terminal of said first winding;

said collector of said second transistor being connected to said second terminal of said second winding;

said bases of said first and second transistors being connected to said control line; and said emitters of said first and second transistors being connected to ground.

16. A network for processing signals from an antenna array, comprising:

a common signal bus;

a plurality of switchable antenna units, each comprising:

an inner winding having first and second terminals, said first terminal being connected to said common signal bus, an outer winding inductively coupled to and wrapped around said inner winding, said outer winding having first and second terminals, said first terminal thereof being connected to ground, a first transistor having a collector, a base, and an emitter, said collector being connected to said second terminal of said inner winding, and said emitter being connected to ground, and a second transistor having a collector, a base, and an emitter, said collector of said second transistor being connected to said second terminal of said outer winding, and said emitter of said second transistor being connected to ground;

control means for selectively switching each said switchable antenna unit between "on" and "off" states, said control means including output means connected to each said base of said first and second transistors;

a preamplifier having an input and an output, said input being connected to said common signal bus; and means for processing the received signals, said signal processing means being connected to said output of said preamplifier, and to said control means.

17. A switchable antenna unit for receiving and conveying electromagnetic signals to a signal bus, comprising:

antenna means including a first winding having a first terminal for connection tot he signal bus, and having a second terminal; and switching means including:

a transistor having a collector, a base, and an emitter, said collector being connected to said second terminal of said first winding, said base being connected to a control line, and said emitter being connected to ground, a second winding having a first terminal connected to said first terminal of said first winding, and having a second terminal, and a capacitor having a first terminal connected to said second terminal of said second winding, and having a second terminal connected to ground.

* * * * *